US005658203A

United States Patent [19]

Shub

[11] Patent Number: 5,658,203

[45] Date of Patent: Aug. 19, 1997

[54] ALIGNMENT DEVICE FOR SPORTS

[76] Inventor: Nelson H. Shub, 37 Wedgewood Rd., Southington, Conn. 06489

[21] Appl. No.: 652,112

[22] Filed: May 23, 1996

[51] Int. Cl.[6] ..... A63B 69/36

[52] U.S. Cl. ..... 473/205; 473/213; 473/214; 473/215; 473/276; 473/277; 473/229; 473/257

[58] Field of Search ..... 446/28; 482/105; 473/215, 216, 213, 214, 205, 276, 277, 229, 257

[56] References Cited

U.S. PATENT DOCUMENTS

| | | | |
|---|---|---|---|
| 3,109,244 | 11/1963 | Trifaro et al. . | |
| 3,595,583 | 7/1971 | Oppenheimer . | |
| 4,422,643 | 12/1983 | Cushing | 473/215 |
| 4,519,608 | 5/1985 | Gilly | 473/215 X |
| 4,582,325 | 4/1986 | Yuhara . | |
| 4,662,640 | 5/1987 | Grander . | |
| 4,758,000 | 7/1988 | Cox . | |
| 5,149,099 | 9/1992 | Radakovich . | |
| 5,269,528 | 12/1993 | McCardle, Jr. . | |
| 5,294,126 | 3/1994 | Armstrong, III . | |
| 5,397,121 | 3/1995 | Gipson et al. | 473/215 |
| 5,472,398 | 12/1995 | Silverman | 482/105 |

OTHER PUBLICATIONS

"Flashing Back To The '40's"—May, 1990—4 pages.

"Wonder Stick" Brochure (correspondence to U.S. Pat. No. 5,529,306)—2 pages.

Flashing Back To The '40's—May, 1996—1 page.

*Primary Examiner*—George J. Marlo

*Attorney, Agent, or Firm*—Cummings & Lockwood

[57] ABSTRACT

An alignment device is disclosed for use in sports such as golfing which includes a generally planar breast plate adapted and configured to be worn adjacent the golfer's chest, an elongated shaft supported by the breast plate and extending laterally therefrom for visually aligning oneself with a distant target on a golf course when addressing a golf ball, and a harness assembly associated with the breast plate for securing the breast plate adjacent the golfer's chest.

10 Claims, 3 Drawing Sheets

ALIGNMENT DEVICE FOR SPORTS

BACKGROUND OF THE INVENTION

1. Field of the Invention

The subject invention is related to an alignment device for sports such as golf, tennis and baseball, and more particularly, to a device for visually aligning oneself with a distant target on a golf course when addressing a golf ball.

2. Background of the Related Art

The prior art abounds with devices for improving one's golf swing and stance when addressing a golf ball. Some of these devices merely include an elongated staff or rod designed to be held in a particular manner by a golfer and used to attain proper hip rotation during a golf swing, as disclosed for example in U.S. Pat. No. 3,109,244 to Trifaro et at. and U.S. Pat. No. 5,269,528 to McCardle, Jr. Other devices, such as those disclosed in U.S. Pat. No. 3,595,583 to Oppenheimer and U.S. Pat. No. 4,758,000 to Cox include elaborate and cumbersome apparatus which are attached to a golfer in such a manner so as to position the golfer in a proper stance and control the actual path of the golfer's swing.

Less elaborate devices which are designed to be worn more comfortably by a golfer to practice a golf swing are also known. Examples of such devices include those disclosed in U.S. Pat. No. 4,582,325 to Yuhara, U.S. Pat. No. 4,662,640 to Grander, U.S. Pat. No. 5,149,099 to Radakovich. These devices include various harness assemblies designed to be worn by a golfer to correct and/or control the golfer's swing.

Although many of the above-identified prior art patents disclose practice devices which are likely to aide in improving one's golf swing, none are configured to enhance the ability of a golfer to properly align their upper body and shoulders with a distant target on a golf course upon addressing a golf ball. Such a device would enable a golfer to direct a golf ball more accurately toward a desired target.

SUMMARY OF THE INVENTION

The subject invention is generally directed to an alignment device for athletes, and in particular, to a body alignment device for a golfer which includes a generally planar breast plate adapted and configured to be worn adjacent the golfer's chest, an elongated shaft supported by the breast plate and extending laterally therefrom within the plane defined by the breast plate for visually aligning one's upper body with a distant target on a golf course when addressing a golf ball, and a harness assembly operatively connected to the breast plate for securing the breast plate adjacent the golfer's chest in such a manner so that the elongated shaft is substantially parallel with the golfer's shoulders.

It is envisioned that the elongated shaft may be fixedly or detachably mounted to the breast plate, or constructed to include a plurality of telescoping shaft segments. Preferably, the harness assembly includes a plurality of adjustable straps including at least one strap configured to extend about the golfer's upper torso, and at least one strap configured to extend about the golfer's shoulders. The harness straps may be constructed of woven nylon or a similar material, and lightweight buckles may be used for length adjustment.

In a preferred embodiment of the subject invention, the alignment device further includes a pair of substantially rigid downwardly angled alignment struts which depend from the elongated shaft in the plane defined by the breast plate for advantageously maintaining the golfer's arms in an outstretched locked position during putting and/or chipping. The alignment struts may be mounted to pivot and/or translate axially with respect to the elongated shaft. In addition, an engagement cuff may be disposed adjacent a terminal end of each alignment strut for receiving and retaining the golfer's wrists.

Further features of the unique alignment device of the subject invention will become more readily apparent to those having ordinary skill in the art from the following detailed description taken in conjunction with the drawings.

BRIEF DESCRIPTION OF THE DRAWINGS

So that those having ordinary skill in the art to which the subject invention appertains will more readily understand how to construct and use the alignment device described herein, preferred embodiments of the device will be described in detail hereinbelow with reference to the drawings wherein.

DETAILED DESCRIPTION OF THE PREFERRED EMBODIMENTS

Figure 1:
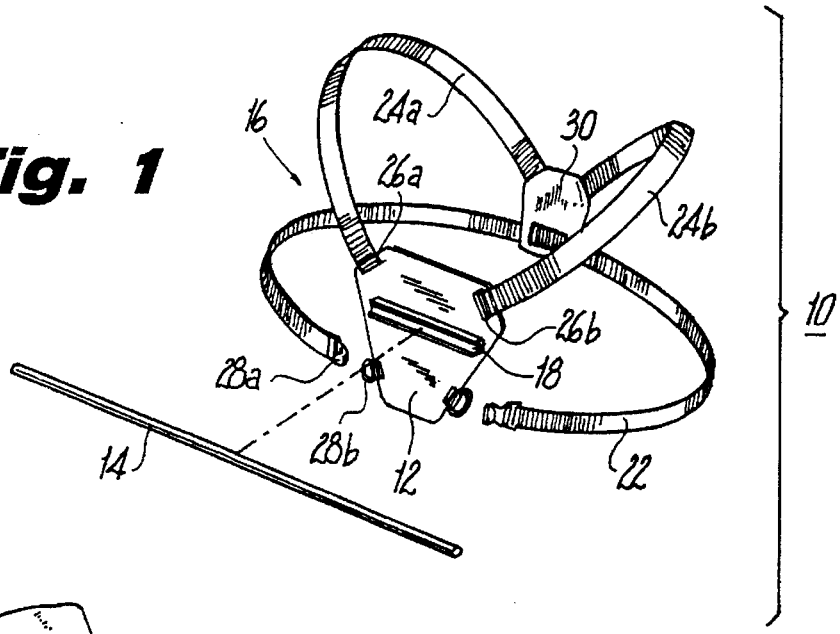
FIG. 1 is a perspective view of an alignment device constructed in accordance with a preferred embodiment of the subject invention which is particularly useful for golfing.
Figure 2:
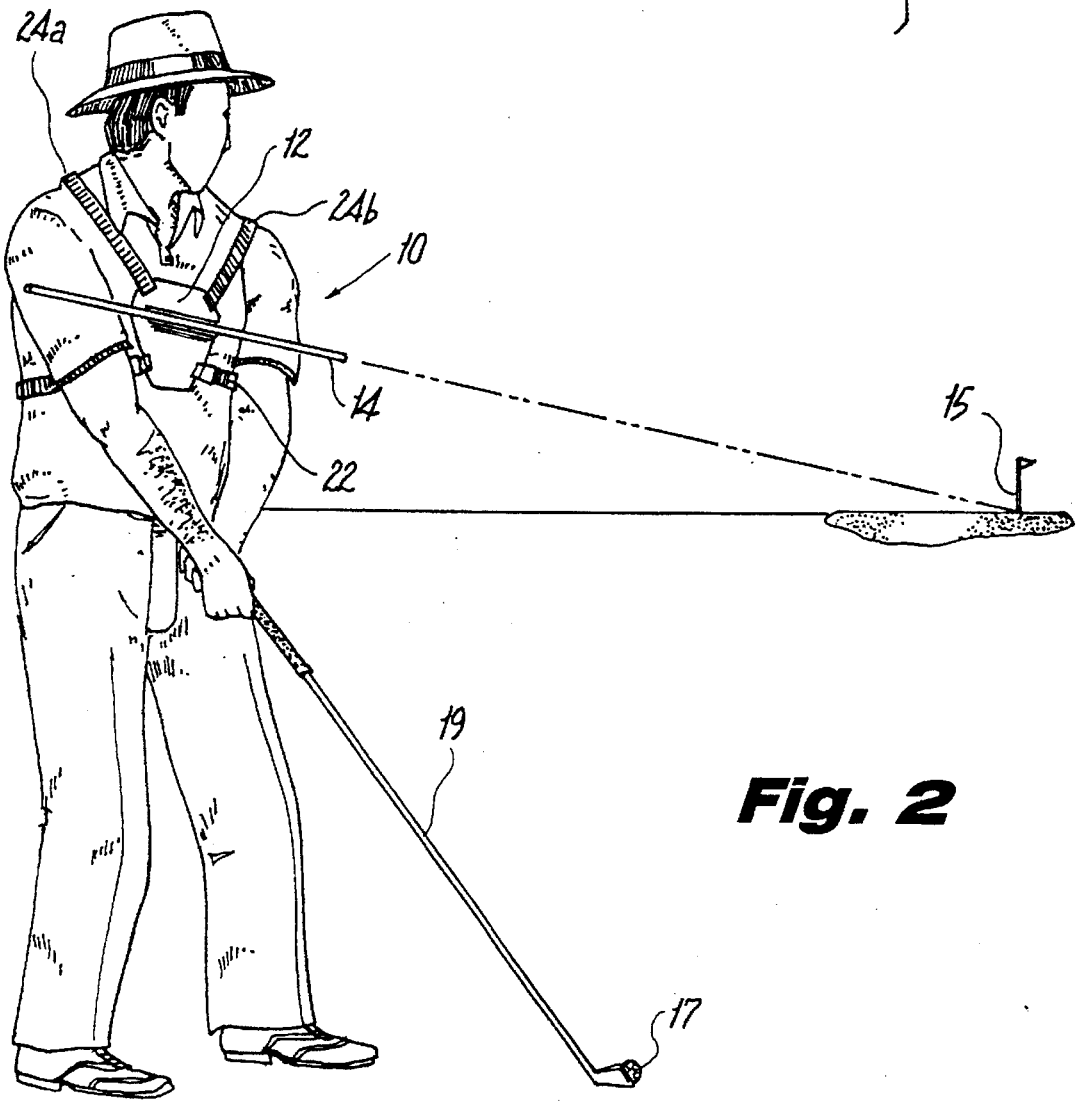
FIG. 2 is an illustration of a male golfer wearing the alignment device shown in FIG. 1 and utilizing the device to align his upper body with a distant target on a golf course.

Referring now to the drawings wherein like reference numerals identify similar structural elements of the subject invention, an alignment device constructed in accordance with a preferred embodiment of the subject invention is illustrated in FIG. 1 and is designated generally by reference numeral 10. As shown in FIG. 2, the alignment device 10 is intended to facilitate visual alignment of one's shoulders with a distant target, such as the flag pole 15 identifying the location of a hole on a golf course, when addressing a golf ball 17. In practice, when the golfer's shoulders are properly aligned with a target, the path of the golfer's club 19 during a golf swing will be such that the path of the golf ball, once struck, is also in line with the target. It envisioned that the alignment device 10 of the subject invention could be used for sports other than golf, wherein athletes are benefited by properly aligning their upper bodies with a target area, such as, for example, tennis or baseball.

Referring now to FIG. 1, in brief, alignment device 10 includes a breast plate 12 adapted and configured to be worn adjacent a golfer's chest, an elongated shaft 14 supported by the breast plate 12 for facilitating visual alignment with a distant target on the golf course, and a harness assembly 16 for securing the breast plate 12 adjacent the golfer's chest in such a manner so that the elongate shaft 14 is parallel with the golfer's shoulders.

The breast plate 12 is generally planar in configuration and is preferably fabricated from a light weight substantially rigid plastic material. The elongated shaft 14 is generally tubular in configuration and is supported adjacent the exterior surface of breast plate 12 by a support fixture 18. Preferably, the shaft is constructed from a light weight plastic material and is detachably mounted to the breast plate so that it may be disengaged from the support fastener for storage purposes. Alteratively, as shown for example in FIG. 3 and discussed in greater detail hereinbelow, the elongated shaft may be constructed from a plurality of telescoping segments which may be extended during use and retracted for storage. Moreover, during use, a golfer may selectively extend either or both sides of the telescoping shaft to facilitate visual alignment with a distant target.

With continued reference to FIG. 1, the harness assembly 16 includes a plurality of adjustable straps including a torso strap 22 which is dimensioned and configured to extend about the upper body or torso of the golfer and two shoulder straps 24*a* and 24*b* which extends across the chest and back of the golfer. The harness straps are preferably fabricated from a light weight woven material, such as, for example, nylon. A pair of spaced apart slots 26*a* and 26*b* are formed adjacent the upper edge of breast plate 12 to receive the forward terminal ends of shoulder straps 24*a* and 24*b*, and a junction pad 30 is provided to interlock the rearward terminal end of each of the shoulder straps adjacent the golfers back. Conventional light weight plastic adjustable clasps and buckles 28*a* and 28*b* are associated with each of the terminal ends of torso strap 22 and the lower side edges of breast plate 12 to facilitate securement and length adjustment of the torso strap. The harness assembly 16 is constructed to be easily removable and comfortable when worn. Moreover, the harness assembly 16 and the alignment device 10 as a whole are constructed to allow normal movement and mobility during a golf swing. Those having ordinary skill in the art will appreciate that alternative harnessing arrangements may be employed with the alignment device of the subject invention.

Figure 3:
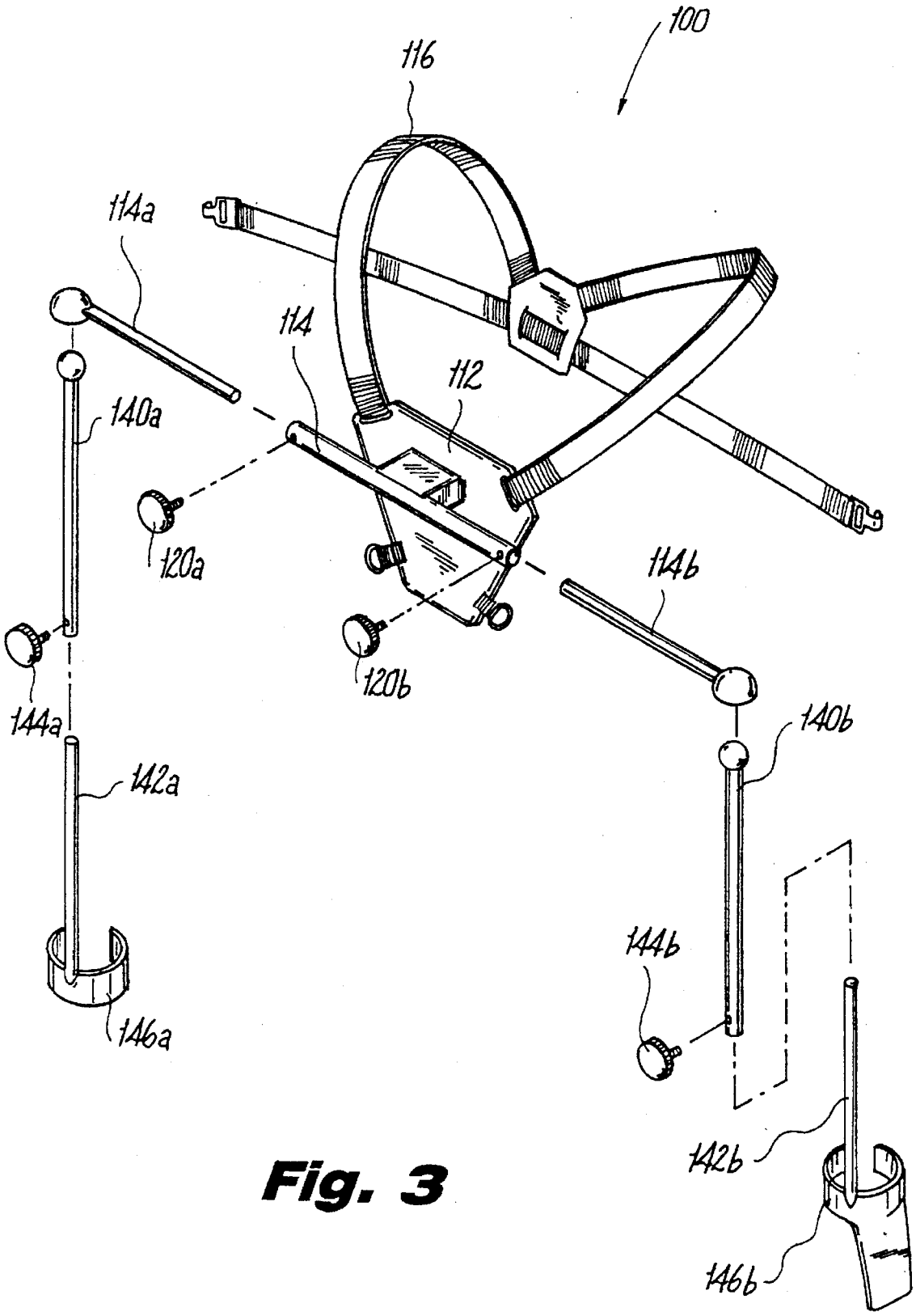
FIG. 3 is a perspective view of an alignment device for golfing constructed in accordance with another preferred embodiment of the subject invention which includes a pair of depending alignment struts.

Referring to FIG. 3, there is illustrated another alignment device constructed in accordance with a preferred embodiment of the subject invention and designated generally by reference numeral 100. Alignment device 100 is substantially similar to the alignment device 10 described hereinabove in that it includes a generally planar substantially rigid breast plate 112, an elongated tubular shaft 114, and a light weight adjustable harness assembly 116. However, alignment device 100 further includes a pair of downwardly depending alignment struts 140*a* and 140*b* which extend from elongated shaft 112 for maintaining a golfer's arms in an outstretched position during putting and/or chipping.

Figure 4:
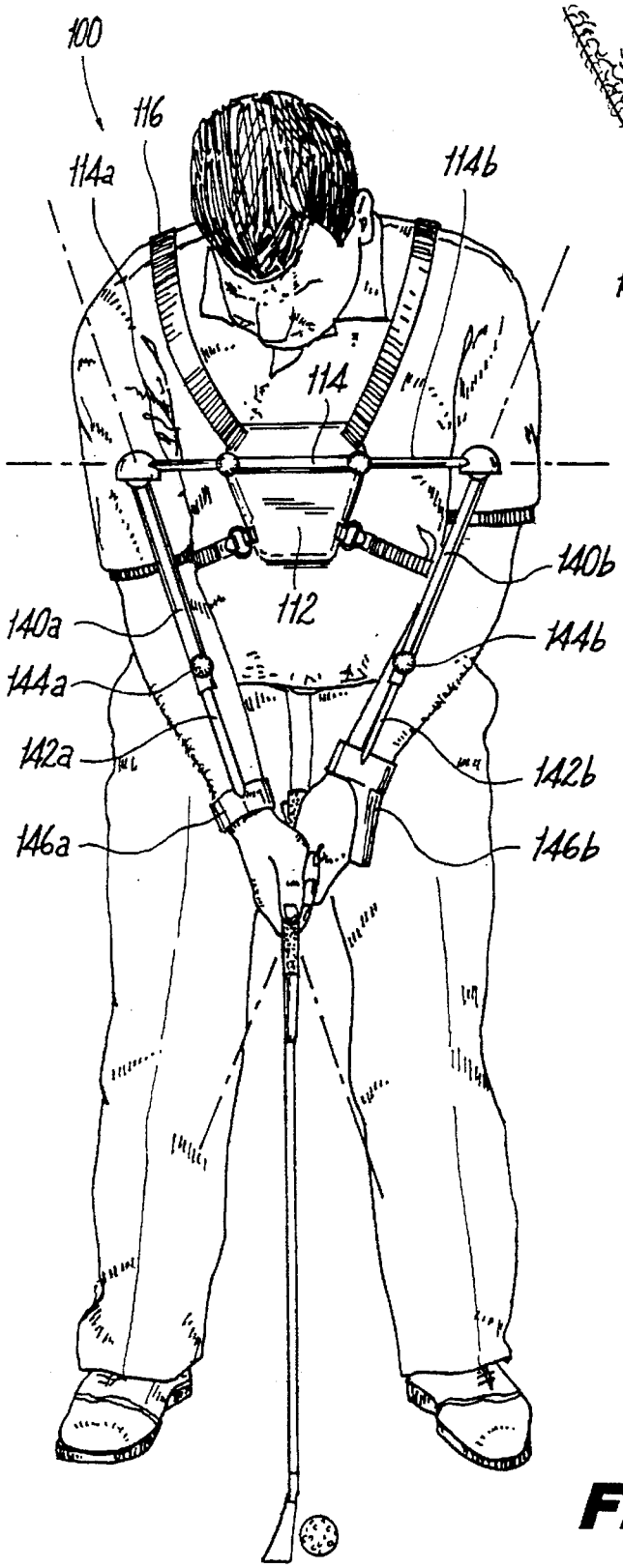
FIG. 4 is an illustration of a male golfer wearing the alignment device shown in FIG. 3 and utilizing the device to maintain his arms in an outstretched locked position during putting.

As illustrated in FIG. 3, the elongated shaft 114 of alignment device 100 is fixedly mounted to the exterior surface of breast plate 112 and includes a pair of opposed telescoping axially adjustable sections 114*a* and 114*b* which are provided to accommodate athletes of different size. Selectively adjustable threaded fasteners 120*a* and 120*b* are positioned adjacent the opposed ends of shaft 114 for bearing against the axially adjustable sections 114*a* and 114*b* to maintain each in a desired axial orientation with respect to shaft 114. Alignment struts 140*a* and 140*b* are pivotably mounted adjacent the terminal ends of shaft sections 114*a* and 114*b*, respectively, and are adapted and configured to maintain a golfer's arms in an outstretched locked position when chipping or putting, as illustrated in FIG. 4. In doing so, a preferred pendulum-like stroke may be achieved. As shown, the connection between the alignment struts and the shaft sections is that of a ball and socket joint. However, other conventional connective mechanisms affording pivotal movement between two structures may be employed.

Figure 5:
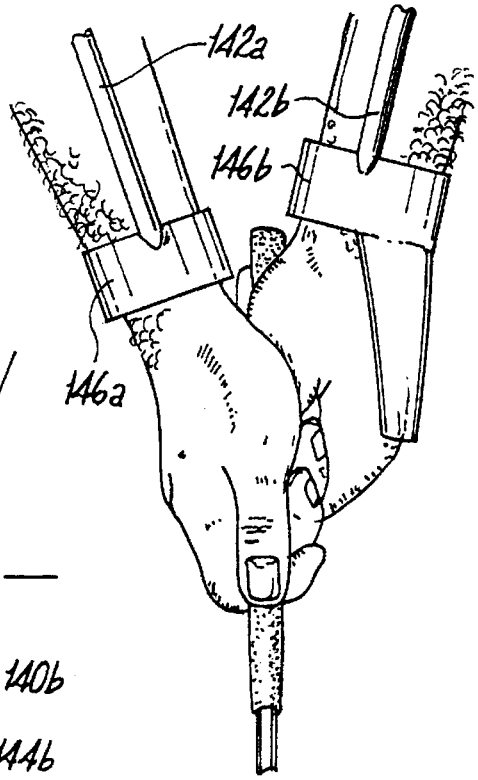
FIG. 5 is an enlarged illustration of the golfer's hands in FIG. 4 showing the wrist engaging cuffs provided at the end of each alignment strut.

As best seen in FIG. 3, struts 140*a* and 140*b* include telescoping adjustable sections 142*a* and 142*b*, respectively, which are provided to accommodate the various arm lengths of golfers. Selectively adjustable threaded fasteners 144*a* and 144*b* are respectively associated with telescoping sections 142*a* and 142*b* for maintaining the telescoping section in a desired lengthwise position. Arcuate wrist engaging cuffs 146*a* and 146*b*, which are best seen in FIG. 5, are associated with the distal ends of strut sections 142*a* and 142*b*, respectively, for receiving and releasably retaining the golfer's wrists during utilization of the device.

Although the alignment device of the subject invention has been described with respect to several preferred embodiments, it is apparent that modifications and changes can be made thereto without departing from the spirit and scope of the invention as defined by the appended claims. Moreover, it will be readily apparent to those skilled in the art that the subject invention can be utilized in sports other than golf, where proper upper body alignment is essential to the activity, such as, for example, tennis and baseball.

What is claimed is:

1. A shoulder plane alignment device for a golfer comprising:

a) a substantially rigid generally planar breast plate having a first interior surface adapted and configured to be worn adjacent a golfer's chest, and a second exterior surface having an elongated support bracket projecting outwardly therefrom and positioned to extend parallel to the shoulder plane of the golfer;

b) an elongated shaft mounted within said support bracket and extending laterally from at least one side of said breast plate in the plane defined thereby for visually aligning oneself with a distant target on a golf course when addressing a golf ball, said elongated support bracket and said elongated shaft having complementary coextensive engaging surfaces; and c) means for securing said alignment device adjacent the golfer's chest in such a manner so that said elongated shaft is substantially parallel with the plane defined by the golfer's shoulders.

2. An alignment device as recited in claim 1, wherein said securing means comprises a harness assembly including at least one adjustable strap member configured to extend about the golfer's body.

3. An alignment device as recited in claim 1, wherein said elongated shaft is detachably mounted in said support bracket.

4. An alignment device as recited in claim 1, wherein said elongated shaft includes a plurality of telescoping shaft segments.

5. An alignment device as recited in claim 1, further comprising a pair of substantially rigid downwardly angled alignment struts depending from said elongated shaft in the plane defined by said breast plate for maintaining the golfer's arms in an outstretched position.

6. An alignment device as recited in claim 5, further comprising means for adjusting the angular position of each of said alignment struts relative to said elongated shaft within the plane defined by said breast plate.

7. An alignment device as recited in claim 5, further comprising means for adjusting the axial position of each of said alignment struts relative to said elongated shaft within the plane defined by said breast plate.

8. An alignment device as recited in claim 5, further comprising means operatively associated with a terminal end of each alignment strut for engaging the golfer's wrist.

9. An alignment device for a golfer comprising:

a) a generally planar breast plate adapted and configured to be worn adjacent a golfer's chest;

b) an elongated shaft supported by said breast plate and extending laterally form either side of said breast plate in the plane defined thereby for facilitating visual alignment with a distant target on a golf course when addressing a golf ball;

c) a harness assembly operatively connected to said breast plate for securing said alignment device adjacent the golfer's chest in such a manner so that said elongated shaft is substantially parallel with the shoulders of the golfer; and d) a pair of substantially rigid downwardly angled alignment struts depending from said elongated shaft in the plane defined by said breast plate for maintaining the arms of the golfer in an outstretched position.

10. An alignment device as recited in claim 9, wherein said harness assembly includes at least one adjustable strap member configured to extend about the body of the golfer.

* * * * *